US008839725B2

(12) United States Patent
Kooistra et al.

(10) Patent No.: US 8,839,725 B2
(45) Date of Patent: Sep. 23, 2014

(54) TABLE APPARATUS

(75) Inventors: Brett Kooistra, Grand Haven, MI (US); Maurice Fredricks, Grand Haven, MI (US); Bruce Fredricks, Grand Haven, MI (US); Benjamin Edinger, Grand Haven, MI (US); Mitchell Mulder, North Muskegon, MI (US)

(73) Assignee: Fredricks Design, Inc., Grand Haven, MI (US)

( * ) Notice: Subject to any disclaimer, the term of this patent is extended or adjusted under 35 U.S.C. 154(b) by 0 days.

(21) Appl. No.: 12/657,616

(22) Filed: Jan. 22, 2010

(65) Prior Publication Data

US 2014/0102340 A1 Apr. 17, 2014

Related U.S. Application Data

(60) Provisional application No. 61/205,657, filed on Jan. 22, 2009.

(51) Int. Cl.

| | |
|---|---|
| ***A47B 9/00*** | (2006.01) |
| ***A47B 13/08*** | (2006.01) |
| ***A47B 11/00*** | (2006.01) |

(52) U.S. Cl.

CPC ..... *A47B 9/00* (2013.01); *A47B 13/088* (2013.01); *A47B 11/00* (2013.01)

USPC ..... 108/147

(58) Field of Classification Search

USPC ..... 108/145–147, 69, 72, 71, 76, 68, 138, 108/48, 49, 73, 75; 248/599, 622, 631, 248/188.3

See application file for complete search history.

(56) References Cited

U.S. PATENT DOCUMENTS

| | | | | |
|---|---|---|---|---|
| 1,656,812 | A * | 1/1928 | Balko et al. | 108/105 |
| 2,170,098 | A * | 8/1939 | Stephenson | 108/136 |
| 2,628,369 | A * | 2/1953 | Urban | 5/86.1 |
| 4,558,847 | A * | 12/1985 | Coates | 254/9 C |
| 4,625,657 | A * | 12/1986 | Little et al. | 108/93 |
| 5,249,533 | A * | 10/1993 | Moore, III | 108/69 |
| 5,549,052 | A * | 8/1996 | Hoffman | 108/139 |
| 5,823,120 | A * | 10/1998 | Holmquist | 108/147 |
| 6,038,986 | A * | 3/2000 | Ransil et al. | 108/145 |
| 6,615,744 | B1 * | 9/2003 | Eckstein et al. | 108/147.2 |
| 7,757,618 | B2 * | 7/2010 | Chang | 108/145 |
| 7,878,129 | B2 * | 2/2011 | Meyer | 108/138 |

(Continued)

*Primary Examiner* — Janet M Wilkens

(74) *Attorney, Agent, or Firm* — The Watson I.P. Group, PLC; Jovan N. Jovanovic; Vladan M. Vasiljevic

(57) ABSTRACT

The disclosure is directed to a table apparatus. The table apparatus includes a support assembly, a surface assembly and an adjustment assembly. The adjustment assembly allows for the movement of a work surface between a first bottom position and a second top position while remaining in the same, preferably, horizontal, orientation throughout the movement thereof. Additionally, the work surface is permitted to rotate about an axis that is perpendicular to the work surface. A secondary work surface is provided, which, when properly set to the same height, cooperates with the work surface to provide a matingly engaged configuration which allows for a substantially continuous joined work surface, while allowing for rotation of the work surface about an axis that is perpendicular to the work surface.

9 Claims, 11 Drawing Sheets

(56) References Cited

U.S. PATENT DOCUMENTS

| | | | | |
|---|---|---|---|---|
| 8,065,966 | B1 * | 11/2011 | Bacon et al. | 108/145 |
| 8,082,857 | B2 * | 12/2011 | George et al. | 108/50.01 |
| 8,262,047 | B2 * | 9/2012 | Lindblad et al. | 248/372.1 |
| 8,439,319 | B2 * | 5/2013 | Page | 248/125.8 |
| 2003/0154890 | A1 * | 8/2003 | Warner | 108/145 |
| 2005/0132935 | A1 * | 6/2005 | Lahmann et al. | 108/49 |
| 2007/0266912 | A1 * | 11/2007 | Swain | 108/145 |
| 2011/0247532 | A1 * | 10/2011 | Jones | 108/147 |

* cited by examiner

TABLE APPARATUS

CROSS REFERENCE TO RELATED APPLICATION

This application claims priority from U.S. Provisional Patent Application Ser. No. 61/205,657 entitled OVERBED TRAY APPARATUS filed Jan. 22, 2009, the entire disclosure of which is hereby incorporated by reference.

BACKGROUND OF THE DISCLOSURE

1. Field of the Disclosure

The disclosure relates in general to a table apparatus, and more particularly, to a table apparatus which is configured to move the table vertically in an upward and downward direction. One particular application, although not being limited thereto, is in the hospital room as an overbed table. Of course, the principles of the invention are applicable to other tables utilized in different locations, both in and out of the medical field.

2. Background Art

The use of tables is well known in the art. Among other uses, it is often necessary to utilize a table in a hospital setting near a hospital bed (for use by the patient or the nurse). It will again be understood that the invention is not limited to use in association with hospitals, hospital rooms, or the medical field; rather, the uses of the table apparatus of the present invention are not limited to use in any particular field or venue. Many of these types of tables have a cantilevered design such that the legs go under the hospital bed while the table stretches across the bed. Typically, the legs have wheels or the like to allow the unit to be slid along the floor.

Many of these tables can be vertically adjusted by an actuator positioned either on the table itself for use by the patient, or remotely positioned near the leg or the support for the nurse's use. The tables typically slide up and down along a shaft, which can result in cumbersome movement. Additionally, it is often necessary to move the entire assembly to achieve a orientation that is suitable for the patient. Another drawback of the conventional tables is that when the table is properly adjusted for the patient, it is typically out of position for the nurse, and when adjusted for the nurse, it is typically poorly adjusted for the patient. In turn, the table may be adjusted dozens of times a day (i.e., every time the nurse or the patient wants to utilize the table).

To overcome these deficiencies, the present table apparatus is provided. The table apparatus has several objects in an effort to overcome the deficiencies of the prior art.

Accordingly, it is an object of the present invention to provide a table apparatus with a work surface that can be easily adjusted by the user and manipulated without moving the entire table apparatus.

It is another object of the present invention to provide a table apparatus that has a plurality of work surfaces that can interact with each other and that can work in cooperation with each other.

It is another object of the invention to provide a table apparatus with a support assembly that is designed to fit into very tight spaces and spaces where it would have been difficult if not impossible to insert prior art designs.

It is another object of the invention to provide a table apparatus which includes a plurality of accessories in the form of drawers and supports to provide additional utility to the table apparatus.

It is an additional object of the invention to provide a table apparatus which includes a work surface that can be easily adjusted up and down between a first bottom position and a second top position while maintaining the same planar orientation throughout the movement (which, in many embodiments, is a horizontal orientation).

These objects as well as other objects of the present invention will become apparent in light of the present specification, claims, and drawings.

SUMMARY OF THE DISCLOSURE

The disclosure is directed to a table apparatus. The table apparatus includes a support assembly, a surface assembly and an adjustment assembly. The support assembly is configured to support the table apparatus relative to an outside surface. The surface assembly includes at least one work surface. The adjustment assembly couples the support assembly to the surface assembly. The adjustment assembly includes a first rotational coupling, a second rotational coupling and a pair of linkages. The first rotational coupling has a pair of spaced apart support axles. The first rotational coupling is attached to the support assembly. The second rotational coupling has a pair of spaced apart surface axles. The second rotational coupling is attached to the surface assembly.

The pair of linkages are substantially the same length. Each one has a first and a second end. The first end of each linkage is coupled to one of the spaced apart support axles of the first rotational coupling. The second end of each linkage is coupled to one of the spaced apart surface axles of the second rotational coupling. When coupled, the linkages are substantially parallel to each other throughout rotation of the linkages relative to the support axles and surface axles between a first bottom position and a second top position. Movement between the first bottom position and the second top position maintains the at least one work surface of the surface assembly in a substantially constant planar orientation.

In a preferred embodiment, the adjustment assembly further comprises a handle assembly movably coupled to the support assembly and movably coupled to at least one linkage. Selective movement of the handle member moves the surface assembly between the first bottom position and the second top position.

In another preferred embodiment, the handle assembly is rotatably coupled to the support assembly and rotatably coupled to one of the linkages.

In another preferred embodiment, the handle assembly further comprises a restraining assembly to maintain the surface assembly in a desired orientation relative to the support assembly. The restraining assembly has at least one actuator configured to selectively release the retention of the adjustment assembly relative to the support assembly.

In one such embodiment, the at least one actuator is coupled to one of the support assembly and the surface assembly.

In another embodiment, the at least one actuator comprises a pair of actuators, one actuator coupled to the support assembly and the other coupled to the surface assembly.

In another embodiment, the adjustment assembly further comprises at least one biasing member having a first end associated with the support assembly and a second end associated with the adjustment assembly. The biasing member facilitates movement of the surface assembly between the first bottom position and the second top position.

Preferably, the biasing member comprises at least one gas spring.

In a preferred embodiment, the surface assembly comprises a table arm having a proximal end and a distal end. The work surface is mounted on the distal end, and the second rotational coupling is located at the proximal end.

In another preferred embodiment, the work surface is rotatably mounted to the distal end of the table arm about a work surface axis that is substantially perpendicular to the work surface. Accordingly, the work surface can rotate about the work surface axis a predetermined angular distance.

In yet another preferred embodiment, the table apparatus further includes a secondary work surface mounted to the support assembly. Between the first bottom position and the second top position, the work surface of the surface assembly is positionable so as to be substantially planar with the secondary work surface.

In another preferred embodiment, the work surface is rotatably mounted to the distal end of the table arm about a work surface axis that is substantially perpendicular to the work surface. Thus, the work surface can rotate about the work surface axis a predetermined angular distance. Further, the secondary work surface includes a secondary work surface perimeter and the work surface includes a work surface perimeter. Placement of the work surface and the secondary work surface in a substantially planar orientation mates the secondary work surface perimeter with the work surface perimeter to define a substantially continuous combined work surface while allowing unimpeded rotation of the work surface about the work surface axis throughout the predetermined angular distance.

In such an embodiment, the work surface perimeter includes a mating region having a substantially outwardly convex configuration, and, the secondary work surface perimeter includes a mating region comprising a substantially outwardly concave configuration. The mating region of the secondary surface perimeter and the work surface perimeter are substantially complementary.

In another aspect of the invention, the invention comprises a table apparatus comprising a support assembly and a surface assembly. The support assembly is configured to support the table apparatus relative to an outside surface. The surface assembly includes a work surface adjustably positionable relative to the support assembly between a first bottom position and a second top position. Additionally, the surface assembly includes a secondary work surface coupled to the support assembly. Between the first bottom position and the second top position, the work surface of the surface assembly is positionable so as to be substantially planar with the work surface.

In a preferred embodiment, the work surface is rotatably mounted to a table arm about a work surface axis that is substantially perpendicular to the work surface. In turn, the work surface can rotate about the work surface axis a predetermined angular distance. Additionally, the secondary work surface includes a secondary work surface perimeter and the work surface includes a work surface perimeter. Placement of the work surface and the secondary work surface in a substantially planar orientation mates the secondary work surface perimeter with the work surface perimeter to define a substantially continuous combined work surface while allowing unimpeded rotation of the work surface about the work surface axis throughout the predetermined angular distance.

In a preferred embodiment, the work surface perimeter includes a mating region having a substantially outwardly convex configuration, and, the secondary work surface perimeter includes a mating region comprising a substantially outwardly concave configuration. The mating region of the secondary surface perimeter and the work surface perimeter are substantially complementary.

In yet another aspect of the invention, the invention comprises a table apparatus comprising a support assembly and a surface assembly. The support assembly is configured to support the table apparatus relative to an outside surface. The surface assembly includes a work surface adjustably positionable relative to the support assembly between a first bottom position and a second top position. The work surface is rotatably mounted to a table arm about a work surface axis that is substantially perpendicular to the work surface. Thus, the work surface can rotate about the work surface axis a predetermined angular distance.

In a preferred embodiment, the predetermined angular distance is between 30° and 360° of rotation.

In another preferred embodiment, the predetermined angular distance is between 90° and 270° of rotation.

BRIEF DESCRIPTION OF THE DRAWINGS

The disclosure will now be described with reference to the drawings wherein.

DETAILED DESCRIPTION OF THE DISCLOSURE

Figure 1:
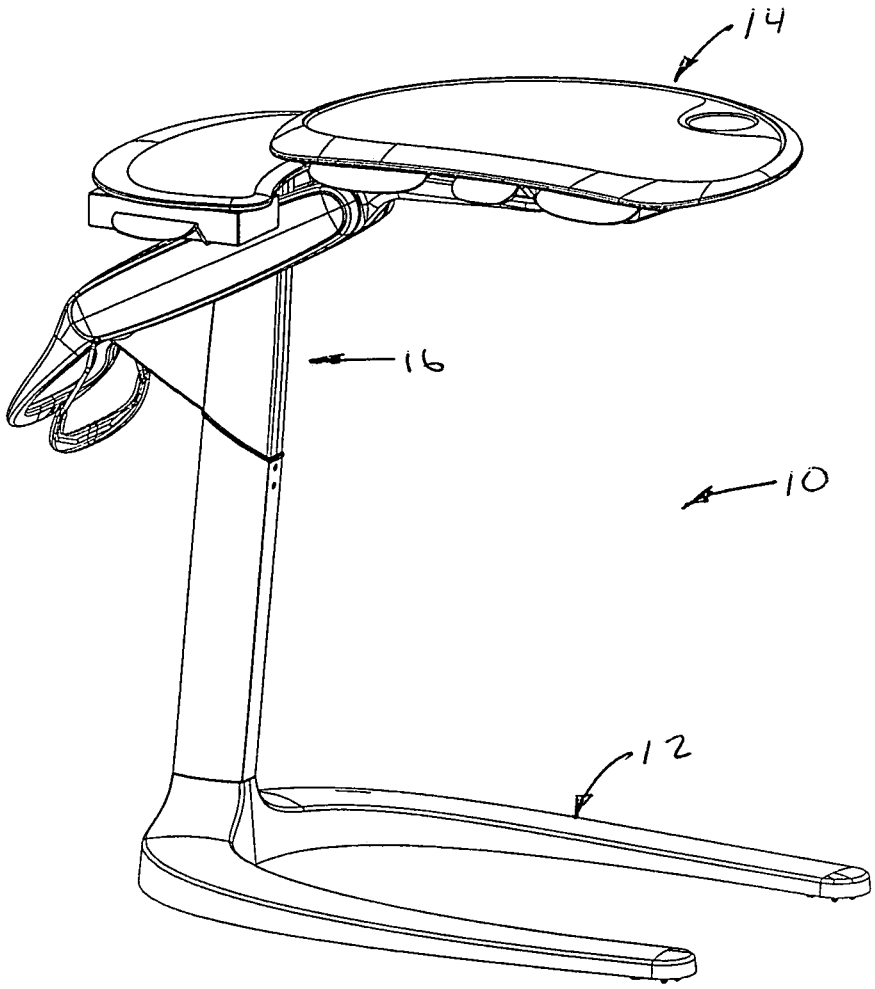
FIG. 1 of the drawings is a perspective view of the table apparatus of the present invention, showing in particular the work surface of the surface assembly in a second top position.
Figure 2:
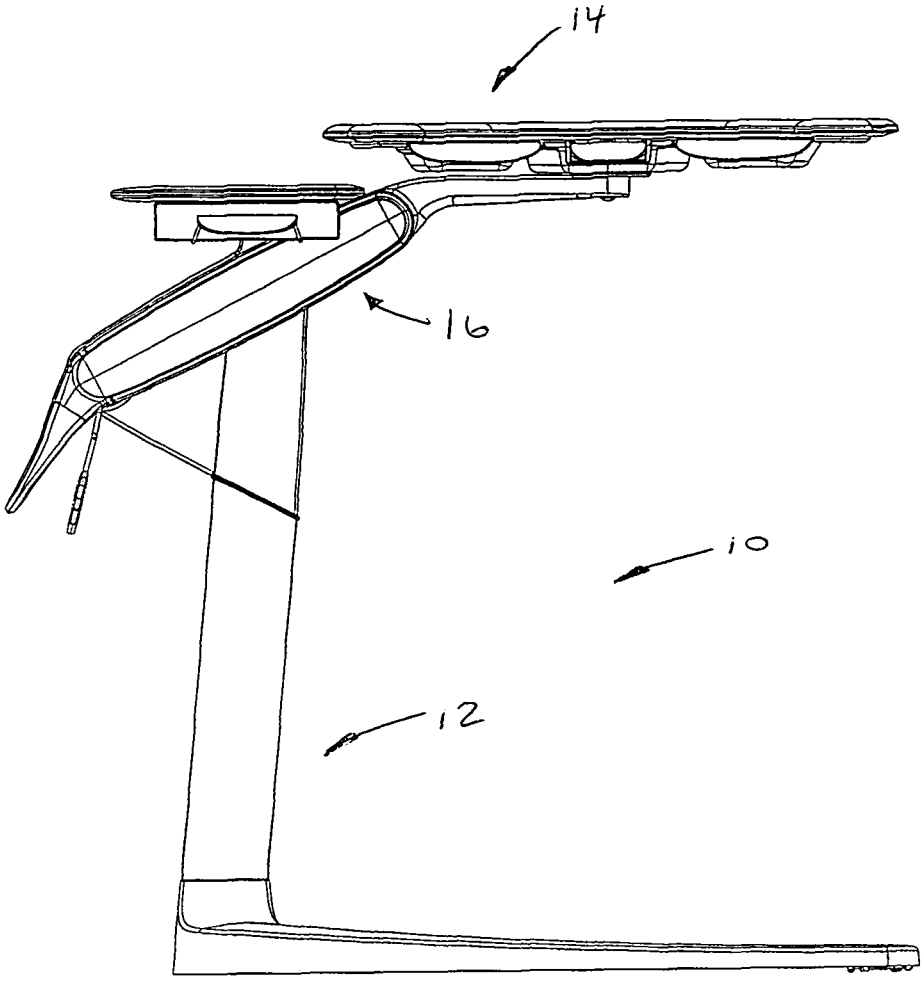
FIG. 2 of the drawings is a side elevational view of the table apparatus of the present invention, showing in particular the work surface of the surface assembly in a second top position.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the table apparatus is shown generally at 10. The table apparatus, in the form shown, is configured for use in association with a hospital bed, in what is commonly known as an over the bed table. Of course, the principles of the disclosure are not limited to use in association with a hospital setting and as an over the bed table, but are likewise configured for use in any number of different applications, including, but not limited to, use in the hospitality industry, educational use, home use, amongst others. Indeed, it will be understood that the potential uses of the principles of the disclosure are limitless.

Figure 5:
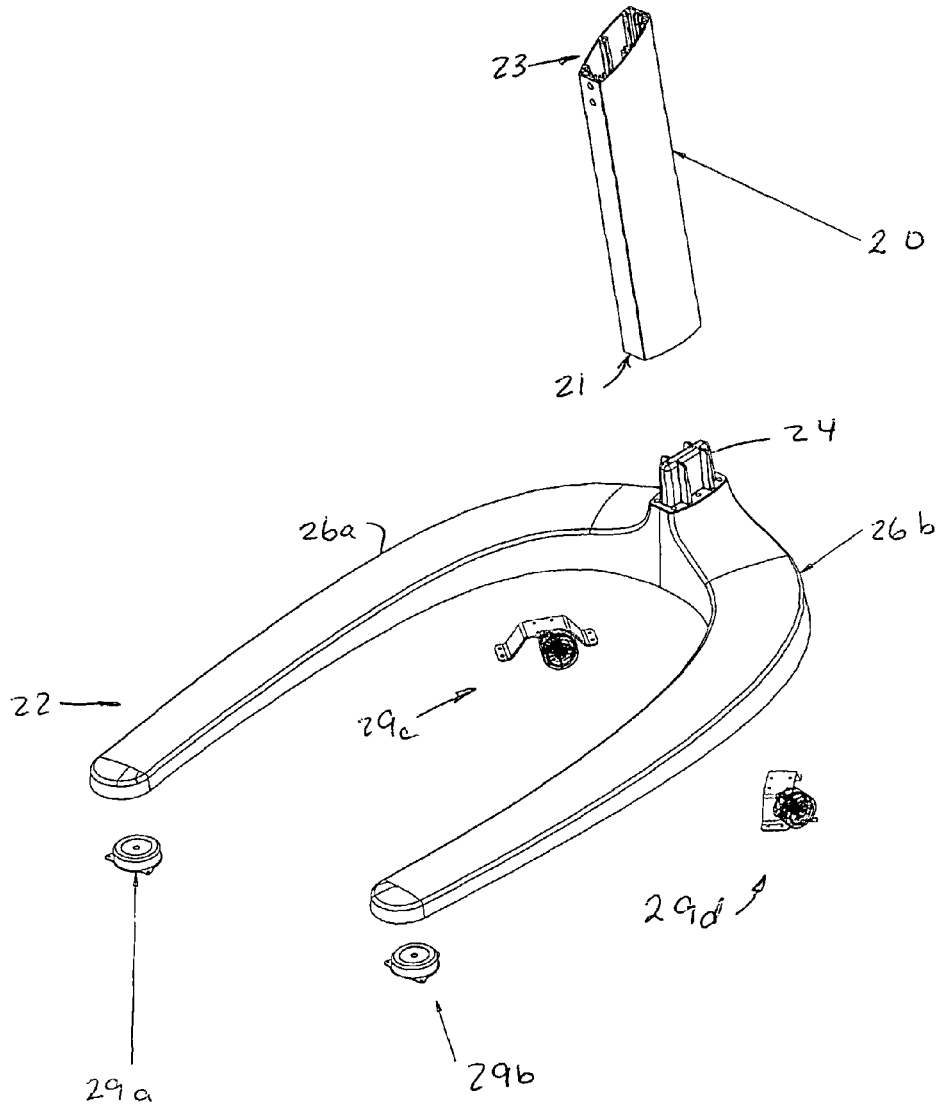
FIG. 5 of the drawings is an exploded view of the support assembly of the present invention.

The table apparatus 10 is shown in FIGS. 1 through 4 as comprising support assembly 12, surface assembly 14 and adjustment assembly 16. These three assemblies are coupled together to form the table apparatus. The support assembly 12, in the preferred embodiment, is shown as being positionable on an outside surface such as the ground. The configuration of the support assembly is well suited for use proximate a hospital bed or the like. With reference to FIG. 5, in such a configuration, the support assembly 12 includes frame member 20 and leg member 22. The frame member 20 comprises an elongated tubular member having a lower end 21 and an upper end 23. In the embodiment shown the frame member comprises a substantially uniform cross-sectional configuration formed through an extrusion process. The profile defines a central hollow region which may be utilized for storage of wiring running from the surface assembly toward or to the ground.

Frame member 22 includes central region coupling 24, and a pair of foot members extending therefrom. The frame member 22 is coupled to the lower end 21 of the frame member 20 by way of the central region coupling 24. In the embodiment shown, the central region coupling 24 substantially corresponds to the cross-sectional configuration of the frame member such that it can be slid into lower end 21 of frame member 20, wherein, it can be coupled thereto utilizing fasteners, adhesives or an interference fit configuration.

As for the foot members, on one side, first foot member 26*a* extends from the central region coupling. On the other side, second foot member 26*b* extends from the central region coupling. Both foot members extend in an arcuate path such that nearing a distal end thereof, the first and second foot members are in a substantially parallel orientation. Such a configuration allows for the surface assembly to be cantilevered while maintaining the requisite balance. The length of the foot members can be varied and will depend on the particular application. In the present application, the foot members are approximately two feet in length. Additionally, the foot members taper toward the distal end so that they can be more easily extended into tight spaces. At various orientations, a plurality of casters 29 and/or wheels can be positioned on the bottom surfaces of the first and second foot members. The low profile configuration requires casters of significant low profile. In other embodiments, casters can be eliminated, and instead, low friction pads or surfaces can be utilized in their place. In other embodiments, a combination of casters and other surfaces can be utilized.

In other embodiments, it will be understood that the foot members can be of different configurations. For example, the foot members may be squared off in nature or angled, as opposed to arcuate. Additionally, a greater or lesser number of leg members can be provided. In still other embodiments, the frame member can have a different configuration wherein multiple frame members can be provided and these can form a base without any leg members (i.e., a tripod). In still other embodiments, the frame member can be bolted to an outside structure, such as wall, a partition or a floor. In such a configuration, the table is fixed in orientation and is precluded from being translated across the floor.

In still other embodiments, it may be removably mountable on various walls, so that it can be moved from location to location. In such an embodiment, a plurality of bases can be provided on various surfaces. In turn, the frame member can be selectively coupled and decoupled from these bases as needed, so that the table apparatus can be moved from one fixed location to another fixed location.

Figure 3:
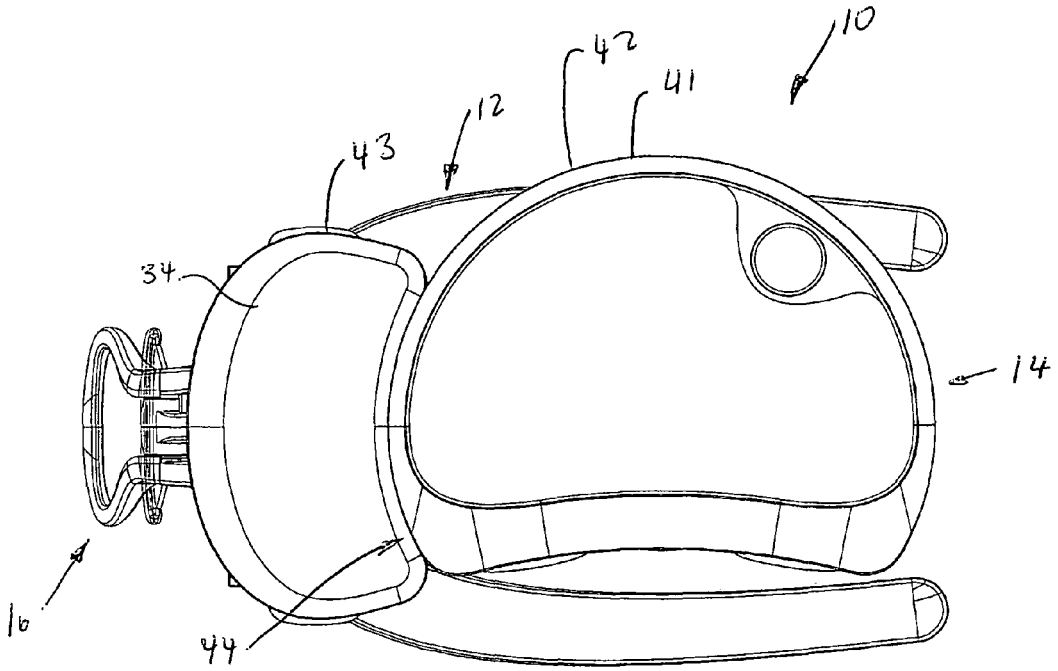
FIG. 3 of the drawings is a top plan view of the table apparatus of the present invention, showing in particular the work surface of the surface assembly in a second top position.
Figure 4:
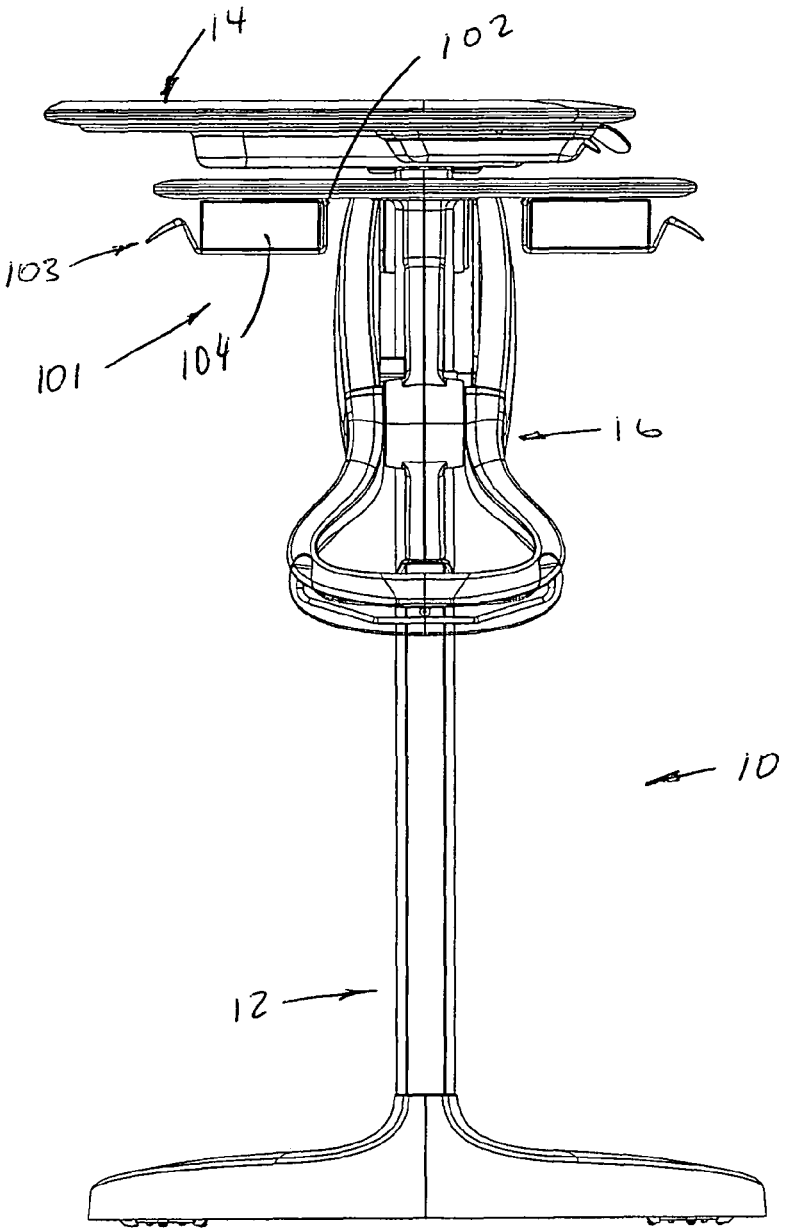
FIG. 4 of the drawings is a back elevational view of the table apparatus of the present invention, showing in particular the work surface of the surface assembly in a second top position.
Figure 6:
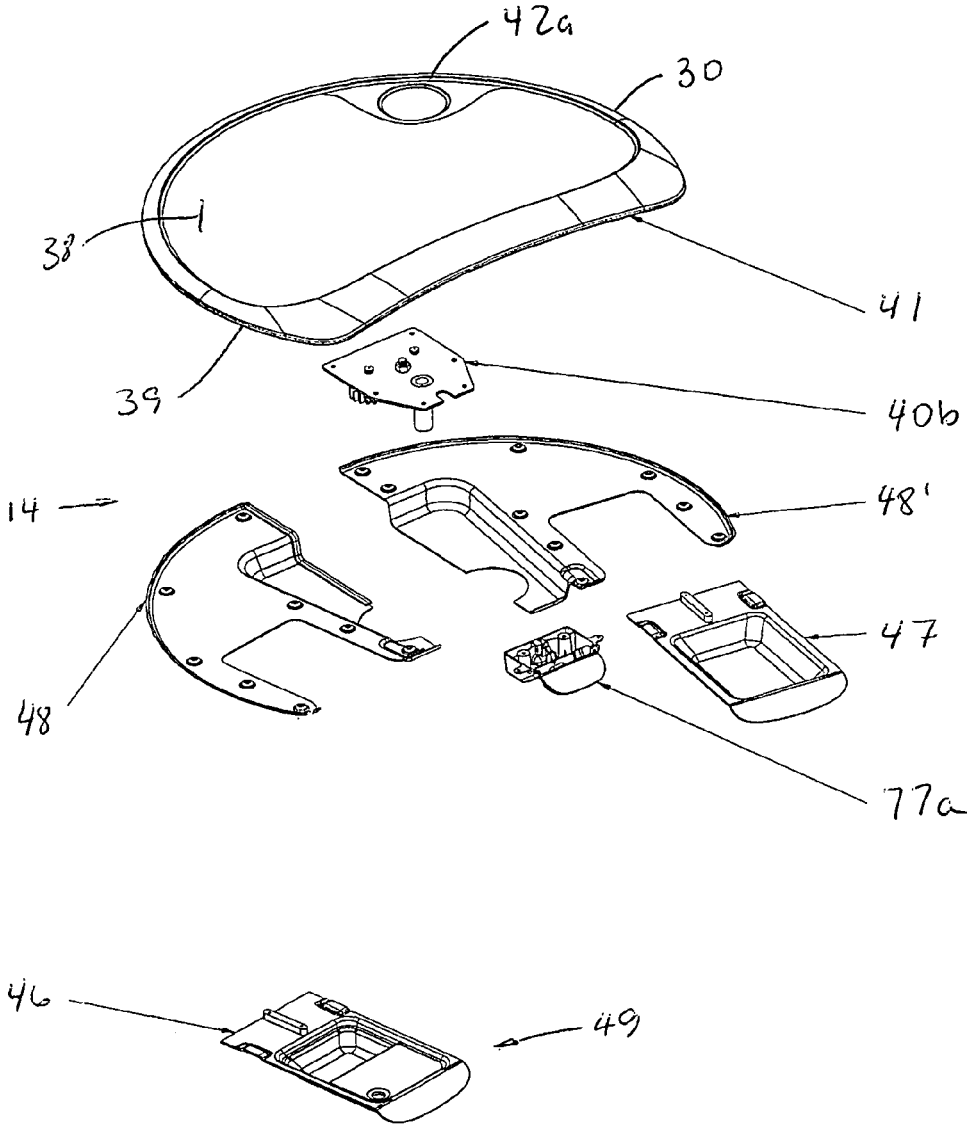
FIG. 6 of the drawings is an exploded view of the surface assembly of the present invention, showing, in particular, various accessory drawers of the present invention.
Figure 7:
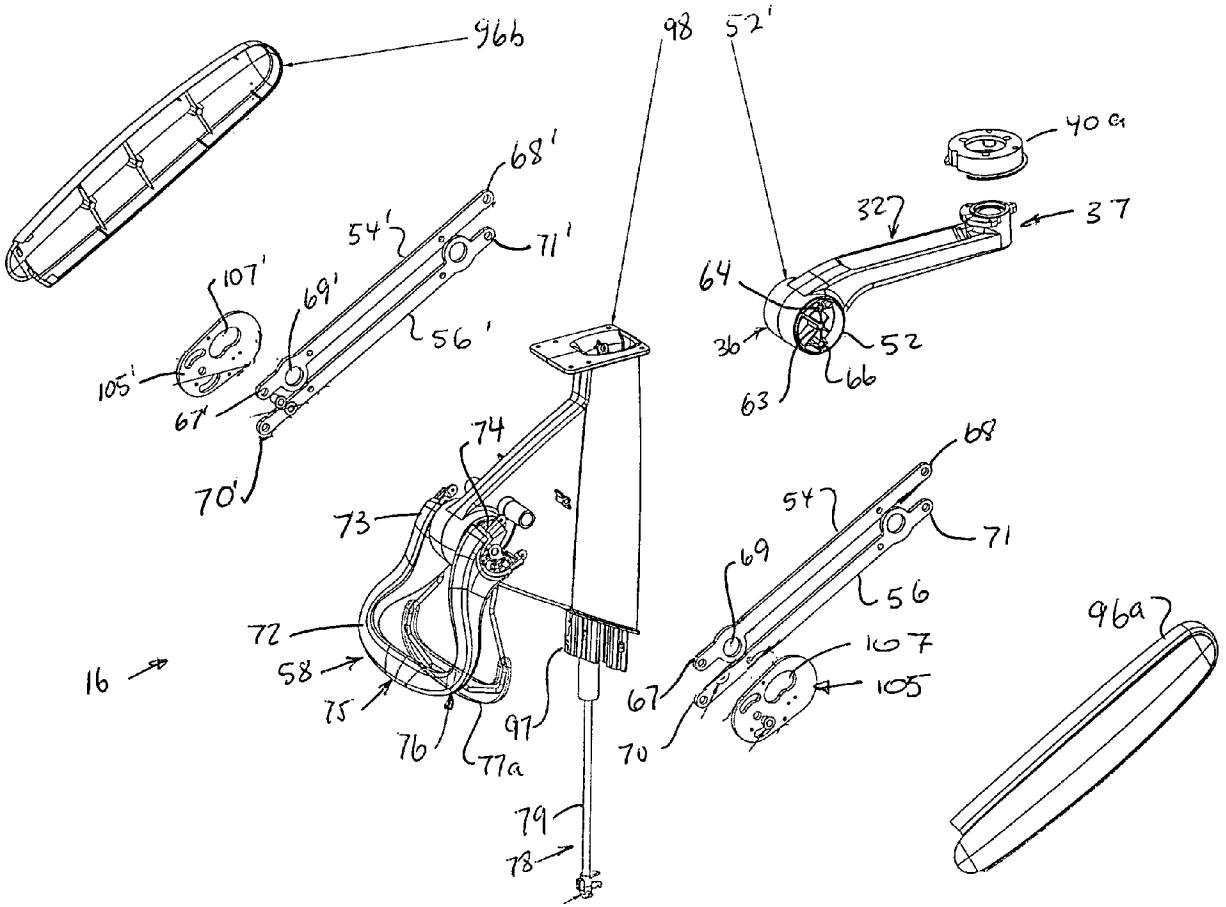
FIG. 7 of the drawings is an exploded view of a portion of the adjustment assembly of the present invention.

Surface assembly 14 is shown in FIGS. 6 and 7, collectively, as comprising work surface 30, table arm 32 and secondary work surface 34 (FIG. 3). The work surface 30 includes top surface 38, bottom surface 39, rotatable coupling components 40*a* (FIG. 7), 40*b*. The work surface 30 further includes work surface perimeter 41. To the bottom surface 39, frame 48, 48' is coupled.

In one embodiment, the work surface 30 may comprise a few square feet of usable space (which may be in the form of a single continuous work surface, or multiple discrete work surfaces). In the embodiment shown, the top surface 38 includes a circular indentation which conveniently holds a glass, cup or can. The work surface perimeter 41 includes a lip or flange thereabout to preclude items (such as pencils/pens, and the like) from rolling off the work surface. The work surface can have any desired configuration and the disclosure is not limited to any particular configuration of the work surface. In this embodiment, as it is desirous of the work surface to integrate with or mate with a secondary work surface, the work surface perimeter includes an outwardly convex mating region 42*a* and a flat or slightly concave opposing region 42*b*. The outer edge may be a resilient, yet elastically deformed polymer member.

The table arm 32 includes proximal end 36 and distal end 37. At the distal end thereof, the table arm 32 is rotatably coupled to the work surface 30 through rotatable coupling components 40*a*, 40*b*. These cooperate to allow the work surface to rotate about a work surface axis of rotation that is substantially perpendicular to the top surface of the work surface. The rotation can be limited to any angular displacement. For example, the rotation of the work surface can be limited to movement between 30° and 360° of rotation, and preferably between 90° and 270°. As will be explained, the second rotational coupling 52 of the adjustment assembly 16 is positioned at the proximal end 36 of the table arm 32. It will be understood that while the distal end 37 of the table arm 32 is shown as being coupled to the work surface in a substantially central location, it is contemplated that the coupling of the table arm and the work surface can occur at any location of the work surface. Additionally, it will be understood that in certain embodiments, the work surface can be fixedly coupled to the table arm such that it is not capable of rotation relative to the table arm.

Referring again to the drawings, in the embodiment shown in FIGS. 1 through 4, the work surface axis of rotation is fixed relative to the table arm. In other embodiments, an additional linkage can be provided. The additional linkage is rotatably coupled to the distal end 37 of the table arm 32 and also rotatably coupled to the bottom surface 39 of the work surface 30. As such, the work surface axis of rotation can be moved relative to the table arm, as the table arm can rotate relative to the table arm about either or both of the rotational couplings at each end of the additional linkage.

The frame can be used to provide rigidity to the work surface and to provide rails or tracks upon which accessory drawers 49 can be provided. In one embodiment, an accessory drawer may be provided with built in power supply, power inverter or charging station. Such a accessory drawer can provide power to accessories such as a PDA, smartphone, laptop, mobile phone, amongst others. Another accessory drawer may include a storage compartment. Still another accessory drawer may include a mirror that can be rotated from a collapsed orientation through an arcuate distance to an inclined orientation that faces the user of the table. As such, the user can pull out the accessory drawer with the mirror and rotate the mirror for viewing himself or herself. The mirror can be re-rotated to the collapsed orientation wherein the drawer can be closed.

With reference to FIG. 3, the secondary work surface 34 is mounted to the top end 98 of the housing 90 of the adjustment assembly 16. The secondary work surface lies in a plane that is substantially parallel to the plane of the work surface (preferably, both of the work surfaces are substantially horizontally oriented). The secondary work surface comprises a secondary work surface perimeter 43 which has a mating region 44. In the embodiment shown, the mating region comprises a substantially outwardly concave configuration with the remaining portion of the perimeter comprising an outwardly convex configuration. A plurality of frame members that are spring loaded can be provided on the bottom surface of the secondary work surface 34. The frame members, such as frame member 101 comprises a frame member that is pivotably coupled to the secondary work surface about rotational axis 102. The frame member can be rotated through handle 103. When the handle is released, the frame member (by way of a biasing means) returns to the configuration shown. As such, a user can rotate the frame member away from the secondary work surface, insert a box of tissues, a garbage bag, a purse, or another item thereto. Once released, the item is captured between the frame and the bottom surface of the secondary work surface.

Figure 9A:
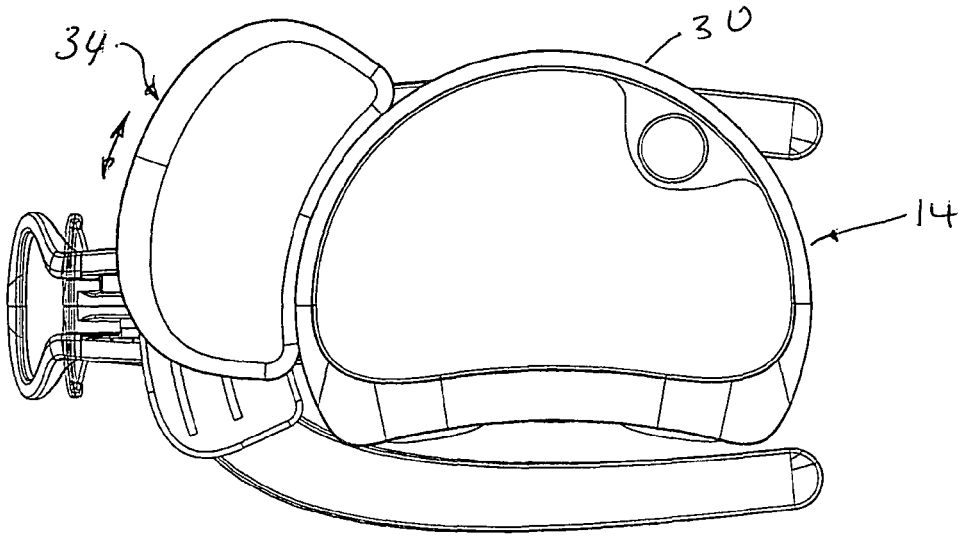
FIG. 9*a* of the drawings is a top plan view of the table apparatus of the present invention, showing, in particular, the secondary work surface translated along runners toward a first side.
Figure 9B:
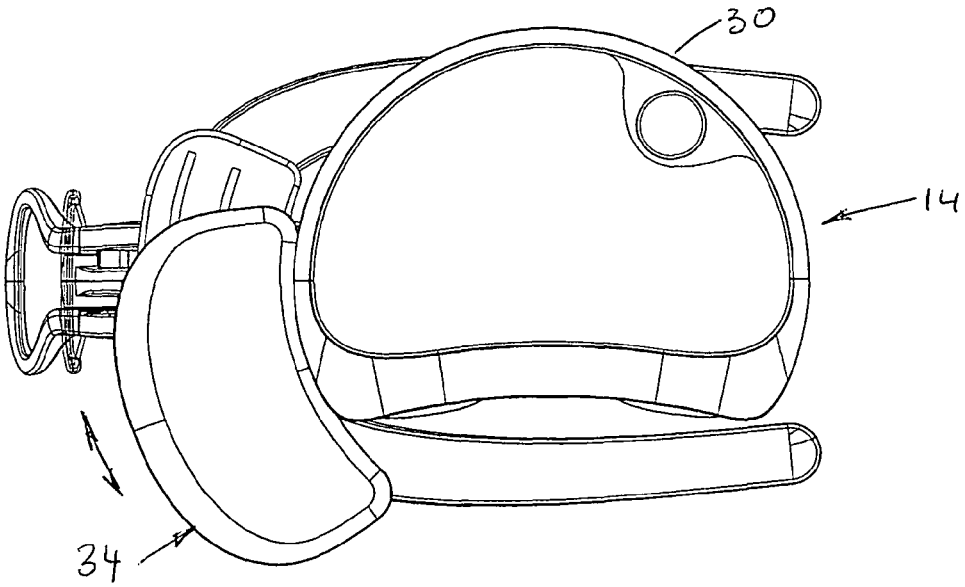
FIG. 9*b* of the drawings is a top plan view of the table apparatus of the present invention shown in FIG. 9*a*, showing, in particular, the secondary work surface translated along runners toward a second side.

In the embodiment shown, the secondary work surface 34 is fixed thereto and is substantially precluded from any rotation or translation. In other embodiments, a member can be coupled to the underside of the secondary work surface 34 and slid into the housing 90 of the adjustment assembly. Such a member can telescope into and out of housing 90 so as to provide the ability to raise or lower the secondary work surface. In other embodiments, such as the embodiment shown in FIG. 11, the secondary work surface can be directly rotatably coupled to the adjustment assembly (whether or not the work surface 30 is fixed or rotatably coupled to the table arm 32). In still other embodiments, a plurality of rotatably mounted links can be positioned between the secondary work surface 34 and the top end 98 of the housing 90 so that the secondary table can rotate about multiple axis of rotation. In still other embodiments, the secondary work surface can be translated between a first side and a second side by way of runners, as is shown in FIGS. 9*a* and 9*b*.

Figure 8:
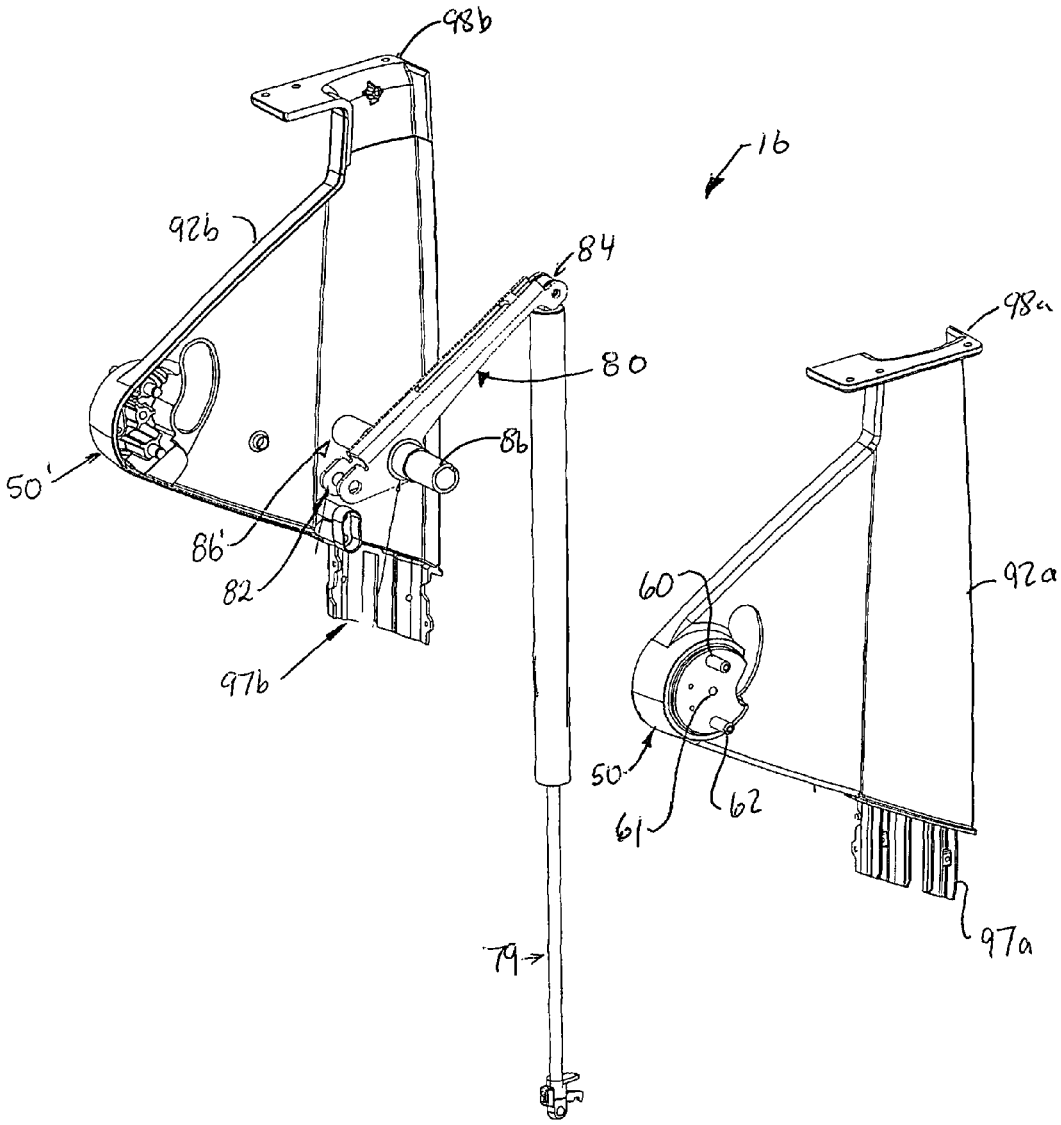
FIG. 8 of the drawings is an exploded view of a portion of the adjustment assembly of the present invention.

Adjustment assembly 16 is shown in FIGS. 7 and 8 collectively as comprising first rotational coupling 50, second rotational coupling 52, first linkage 54, second linkage 56 and handle assembly 58. It will be understood that the first and second rotational couplings have opposing structures, 50' and 52' which are identical to the structures 50, 52 respectively. Additionally, a second set of linkages 54', 56' are coupled to the opposing structures 50', 52'. Inasmuch as these structures are substantially identical, the first rotational coupling 50, second rotational coupling 52, and linkages 54, 56 will be described in detail and it will be understood that the opposing first rotational coupling 50', opposing second rotational coupling 52', and linkages 54', 56' are substantially mirror images thereof. Thus, the same reference will be utilized augmented by a prime (').

Figure 11:
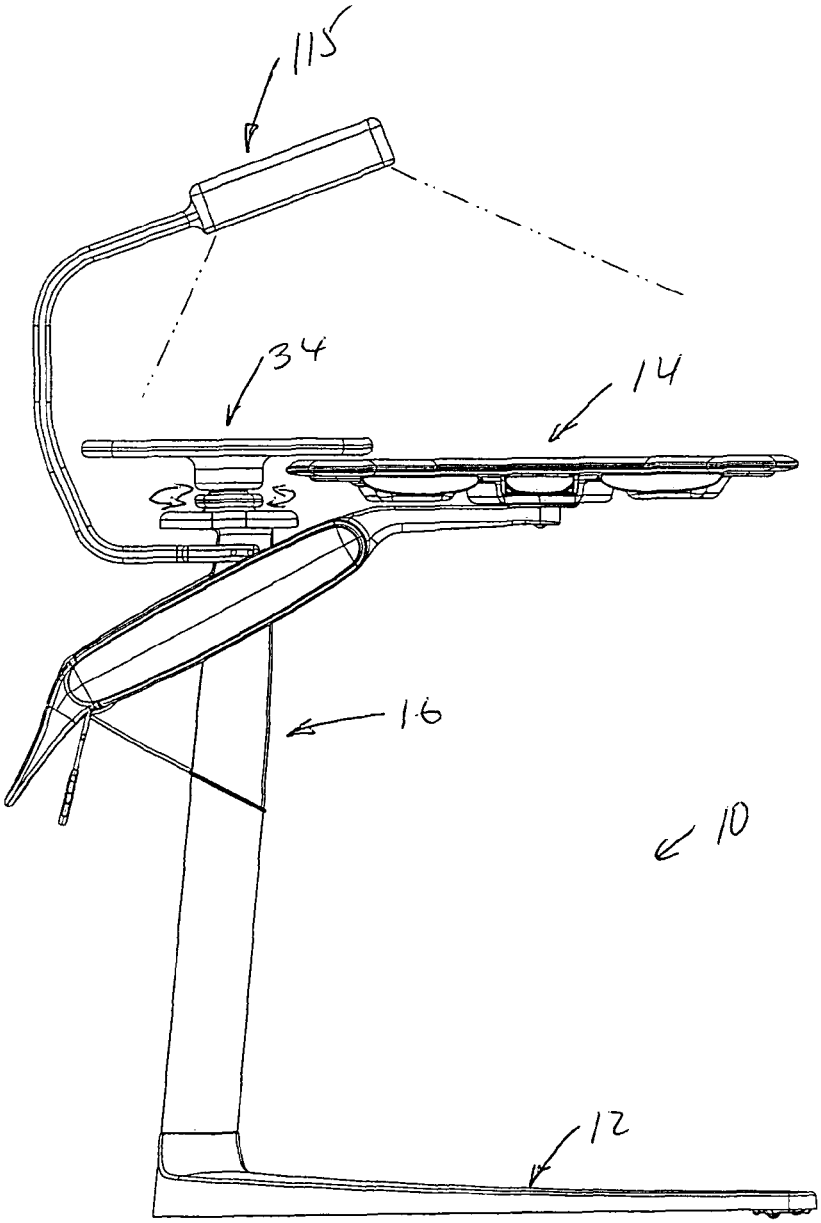
FIG. 11 of the drawings is a side elevational view of an embodiment of the table apparatus of the present invention, showing, in particular, the work surface having a light source directed thereto.

The adjustment assembly 16 further includes housing 90 which internally includes certain components, and to which certain components are mounted. The housing 90 includes first component 92*a* and second component 92*b*. The housing includes bottom end 97 which is coupled to upper end 23 of the frame member 20. In the configuration shown, the bottom end 97 is slid into the frame member and coupled thereto. The housing further includes top end 98 to which the secondary work surface 34 is coupled. In certain embodiments, such as is shown in FIG. 11, the housing may include a light source 115 which extends therefrom and which illuminates at least one of the work surface and the secondary work surface. In certain embodiments, it may illuminate both of the work surfaces. The power for the light source can be housed within the light source housing itself, or within any one of the housing 90 or the components of the support assembly. It is contemplated that the light source comprise, for example, a LED light, while other types of lights, halogen, incandescent, and others are likewise contemplated.

First rotational coupling 50 extends from first component 92*a* of housing 90 and includes first support axle 60, second support axle 62 and central axle 61. The first support axle 60 and the second support axle 62 are positioned on opposing sides of the central axle 61 and substantially equidistantly therefrom. In the embodiment shown, the two support axles are positioned vertically below and above the central axle. Of course, other configurations are likewise contemplated.

The second rotational coupling 52 includes first surface axle 64, second surface axle 66 and central surface axle 63. The second rotational coupling is mounted to the proximal end 36 of the table arm 32. The configuration of the second rotational coupling 52 is substantially identical to that of the first rotational coupling. In particular, the two surface axles are positioned vertically above and below the central surface axle and spaced apart therefrom.

The first linkage 54 includes first end 67, second end 68 and spring arm interface 69. The first end 67 is coupled to the first support axle 60 of the first rotational coupling 50. The second end 68 is coupled to the first surface axle 64 of the second rotational coupling 52. The second linkage 56 includes first end 70 and second end 71. The first end 70 is coupled to the second support axle 62 of the first rotational coupling 50. The second end 71 is coupled to the second surface axle 66 of the second rotational coupling 52.

When mounted, the first and second linkages 54, 56 are substantially identical in length, and they are substantially parallel in orientation regardless of the relative position of the first rotational coupling 50 and the second rotational coupling 52. The linkages 54, 56 can be maintained within linkage housing 96*a*, 96*b*. The housing covers the linkages and precludes inadvertent injury and damage caused by objects interfering with the movement of the two linkages.

Handle assembly 58 is shown in FIGS. 7 and 8, collectively, as comprising restraining assembly 76, biasing member 78 and spring arm 80. The handle assembly is coupled to the housing 90, with the spring arm 80 and the biasing member 78 being housed therewithin. The handle assembly 58 includes a handle body 72 having a first end 73 coupled to the first rotational coupling 50 and rotatable relative to control axle 61, a second end 74 coupled to the opposing first rotational coupling 50' and a grasping region 75 therebetween. The first end 73 likewise includes cam member 105 having cam surface 107.

Spring arm 80 includes first end 82 which is configured to rotate about an axis of rotation proximate the central axle 61, and a second end 84, and linkage interface (follower) 86, 86'. The linkage interface, or follower, extends through cam surface 107 and through spring arm interface 69 of the first linkage 54. The second end 84 of the spring arm 80 is further coupled to a biasing member 79. In particular, the biasing members, in this embodiment, comprise gas springs, although other types of biasing members are likewise contemplated. Biasing member 79 is coupled to the frame member 20 or leg member 22 of the support assembly 12. In many embodiments, the biasing member is actuated by a button, or a release button on the biasing member. When the button is triggered, the biasing member can be adjusted. It will be understood that in certain embodiments, the biasing member can be overridden to raise the work surface, while depressing of the button is required to lower the work surface.

The restraining assembly 76 further includes at least one actuator, such as actuator 77*a*. The actuator actuates the button on the biasing member and allows the handle member to move rotatably about the central axle 61 of the first rotational coupling 50 of the adjustment assembly 16. In another embodiment, an additional actuator can be positioned remotely, such as, for instance, on the bottom side of the work surface 30. Of course, other actuation members can likewise be utilized.

In operation, the table apparatus 10, is first directed to an area where it is to be utilized. Inasmuch as the leg members include casters 29*a-c*, the table apparatus can be easily directed along a surface. In addition, due to the low profile of the leg members, the table apparatus can be slid underneath structures typically deemed too low for other such table apparatuses.

Figure 10A:
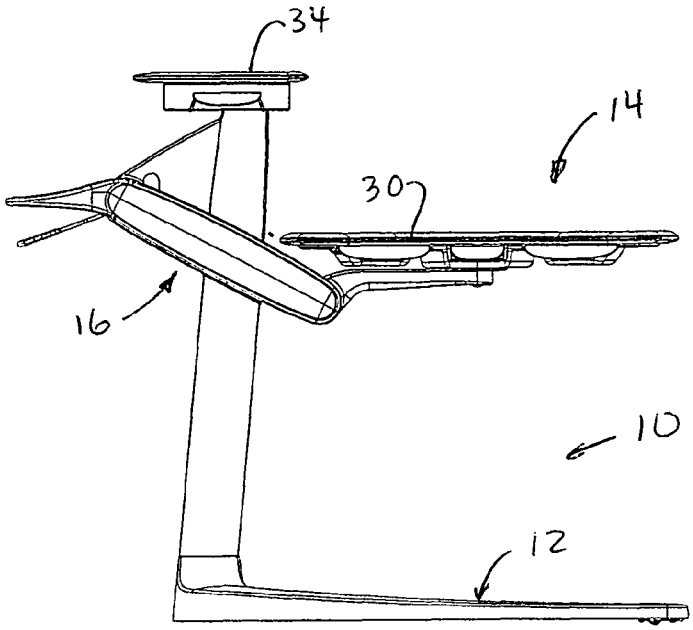
FIG. 10*a* of the drawings is a side elevational view of the table apparatus of the present invention, showing, in particular, the work surface of the surface assembly in a first bottom position.

Once positioned, the work surface can be adjusted between a first bottom position, shown in FIG. 10*a*, and a second top position, shown in FIG. 1. In the first bottom position, the work surface is substantially horizontal, and the first and second linkages are oriented in a downward direction between the first rotational coupling 50 and the second rotational coupling 52.

If the user desires to raise the work surface from the first bottom position toward or into the second top position, the user first triggers actuator 77 and then grasps the handle member, pushing the handle member in a downward direction. Imparting a downward rotation to the handle member directs the cam member 105 and the cam surface 107 in an upward direction. The cam surface 107 imparts motion onto the follower (or the linkage interface 86). The follower is coupled to the spring arm interface 69 which imparts rotation to the first linkage 54 in the upward direction.

Inasmuch as the first and second linkages 54, 56 are coupled together, they move in unison raising the table arm 32. Due to the configuration and relationship between the first and second linkages, the two linkages remain parallel throughout the rotation thereof and, consequently, maintain the angular disposition of the table arm 32 such that the table arm 32 moves up and down, but does not rotate. In turn, the work surface 30 remains in a substantially horizontal orientation and does not vary from the horizontal orientation throughout the movement. When the work surface is raised to a desired level, the actuator is released to restrain the work surface in the newly set orientation.

It will be understood that the spring arm 80 rotates with the rotation of the handle member. Inasmuch as the spring arm 80 is coupled to the biasing members, the biasing members act upon the spring arm 80, and, in turn, the linkages, aiding in the movement thereof (i.e., lessening the force required to move the work surface).

Figure 10B:
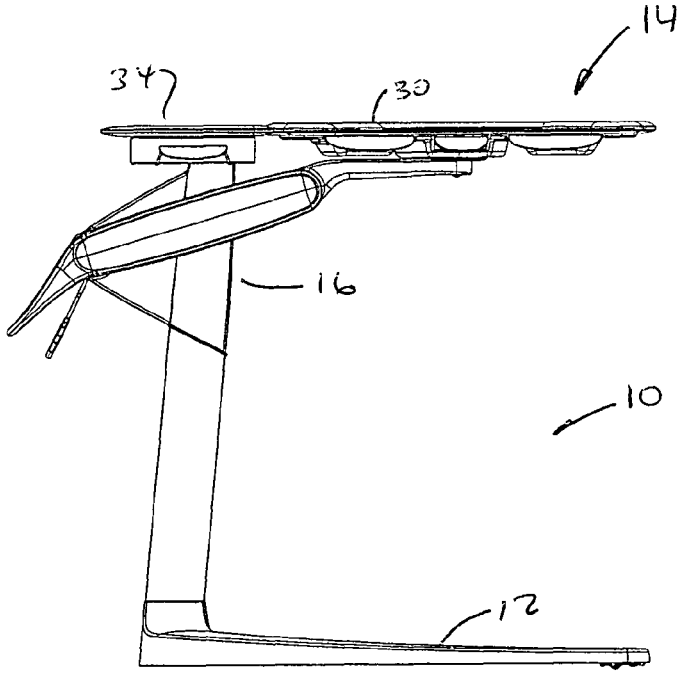
FIG. 10*b* of the drawings is a side elevational view of the table apparatus of the present invention, showing, in particular, the work surface of the surface assembly in a position wherein the work surface and the secondary work surface are substantially coplanar.

In any desired orientation of the work surface between the first bottom position and the second top position, the work surface can be rotated about the work surface axis. The work surface and the secondary work surface are oriented and configured such that when the work surface is raised or lowered to be planar with the secondary work surface, the perimeters of each matingly engage to render a substantially continuous joined or combined work surface (such as is shown in FIG. 10*b*). Additionally, due to the mating convex and concave surfaces of each of the perimeters of the work surface and the secondary work surface, the work surface is permitted to rotate about the work surface axis without interfering with the secondary work surface.

To lower the work surface, the user again grasps the actuator (or, where there is more than one actuator, any of the actuators) and rotates the handle member to raise the same. The rotation of the handle member imparts rotation to the cam member 105 directing the cam surface 107 to move the linkage interface 86 which is coupled to the first linkage at spring arm interface 69. This imparts a rotation to the first and second linkages in a direction which moves the work surface 30 in the downward direction. Again, due to the geometry of the first linkage and the second linkage, the work surface remains in the same planar relationship, in this embodiment, a substantially horizontal configuration. Once the desired orientation is reached, the user releases the actuator.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A table apparatus comprising:

a support assembly configured to support the table apparatus relative to an outside surface;

a surface assembly including at least one work surface; and an adjustment assembly coupling the support assembly to the surface assembly, the adjustment assembly comprising:

a first rotational coupling having a pair of spaced apart support axles, the first rotational coupling attached to the support assembly;

a second rotational coupling having a pair of spaced apart surface axles, the second rotational coupling attached to the surface assembly;

a pair of linkages of substantially the same length, each having a first end and a second end, the first end of each linkage coupled to one of the spaced apart support axles of the first rotational coupling, the second end of each linkage coupled to one of the spaced apart surface axles of the second rotational coupling, wherein when coupled, the linkages are substantially parallel to each other throughout rotation of the linkages relative to the support axles and surface axles between a first bottom position and a second top position, whereby movement between the first bottom position and the second top position maintains the at least one work surface of the surface assembly in a substantially constant planar orientation; and wherein the adjustment assembly further comprises a handle assembly movably coupled to the support assembly and movably coupled to at least one linkage, whereupon selective movement of the handle member moves the surface assembly between the first bottom position and the second top position; and wherein the handle assembly further comprises a restraining assembly to maintain the surface assembly in a desired orientation relative to the support assembly, the restraining assembly having at least one actuator configured to selectively release the retention of the adjustment assembly relative to the support assembly.

2. The table apparatus of claim 1 wherein at least one actuator is coupled to one of the support assembly and the surface assembly.

3. The table apparatus of claim 2 wherein at least one actuator comprises a pair of actuators, one actuator coupled to the support assembly and the other coupled to the surface assembly.

4. A table apparatus comprising:

a support assembly configured to support the table apparatus relative to an outside surface;

a surface assembly including at least one work surface; and an adjustment assembly coupling the support assembly to the surface assembly, the adjustment assembly comprising:

a first rotational coupling having a pair of spaced apart support axles, the first rotational coupling attached to the support assembly;

a second rotational coupling having a pair of spaced apart surface axles, the second rotational coupling attached to the surface assembly;

a pair of linkages of substantially the same length, each having a first end and a second end, the first end of each linkage coupled to one of the spaced apart support axles of the first rotational coupling, the second end of each linkage coupled to one of the spaced apart surface axles of the second rotational coupling, wherein when coupled, the linkages are substantially parallel to each other throughout rotation of the linkages relative to the support axles and surface axles between a first bottom position and a second top position, whereby movement between the first bottom position and the second top position maintains the at least one work surface of the surface assembly in a substantially constant planar orientation; and wherein the adjustment assembly further comprises a handle assembly movably coupled to the support assembly and movably coupled to at least one linkage, whereupon selective movement of the handle member moves the surface assembly between the first bottom position and the second top position; and wherein the adjustment assembly further comprises at least one biasing member having a first end associated with the support assembly and a second end associated with the adjustment assembly, the biasing member facilitates movement of the surface assembly between the first bottom position and the second top position.

5. The table apparatus of claim 4 wherein the biasing member comprises at least one gas spring.

6. A table apparatus comprising:

a support assembly configured to support the table apparatus relative to an outside surface;

a surface assembly including a work surface adjustably positionable relative to the support assembly between a first bottom position and a second top position, and, a secondary work surface coupled to the support assembly;

wherein between the first bottom position and the second top position, the work surface of the surface assembly is positionable so as to be substantially planar with the secondary work surface;

wherein the work surface is rotatably mounted to a table arm about a work surface axis that is substantially perpendicular to the work surface, wherein the work surface can rotate about the work surface axis a predetermined angular distance; and wherein the secondary work surface includes a secondary work surface perimeter and the work surface includes a work surface perimeter, whereupon placement of the work surface and the secondary work surface in a substantially planar orientation mates the secondary work surface perimeter with the work surface perimeter to define a substantially continuous combined work surface while allowing unimpeded rotation of the work surface about the work surface axis throughout the predetermined angular distance.

7. The table apparatus of claim 6 further comprising:

an adjustment assembly coupling the support assembly to the surface assembly, the adjustment assembly comprising:

a first rotational coupling having a pair of spaced apart support axles, the first rotational coupling attached to the support assembly;

a second rotational coupling having a pair of spaced apart surface axles, the second rotational coupling attached to the surface assembly;

a pair of linkages of substantially the same length, each having a first end and a second end, the first end of each linkage coupled to one of the spaced apart support axles of the first rotational coupling, the second end of each linkage coupled to one of the spaced apart surface axles of the second rotational coupling, wherein when coupled, the linkages are substantially parallel to each other throughout rotation of the linkages relative to the support axles and surface axles between a first bottom position and a second top position, whereby movement between the first bottom position and the second top position maintains the at least one work surface of the surface assembly in a substantially constant planar orientation; and wherein the surface assembly comprises a table arm having a proximal end and a distal end, the work surface being mounted on the distal end, and the second rotational coupling located at the proximal end; and further comprising a secondary work surface mounted to the support assembly.

8. A table apparatus comprising:

a support assembly configured to support the table apparatus relative to an outside surface;

a surface assembly including a work surface adjustably positionable relative to the support assembly between a first bottom position and a second top position, and, a secondary work surface coupled to the support assembly;

wherein between the first bottom position and the second top position, the work surface of the surface assembly is positionable so as to be substantially planar with the secondary work surface;

wherein the work surface is rotatably mounted to a table arm about a work surface axis that is substantially perpendicular to the work surface, wherein the work surface can rotate about the work surface axis a predetermined angular distance; and wherein the secondary work surface includes a secondary work surface perimeter and the work surface includes a work surface perimeter, whereupon placement of the work surface and the secondary work surface in a substantially planar orientation mates the secondary work surface perimeter with the work surface perimeter to define a substantially continuous combined work surface while allowing unimpeded rotation of the work surface about the work surface axis throughout the predetermined angular distance; and wherein the work surface perimeter includes a mating region having a substantially outwardly convex configuration, and, the secondary work surface perimeter includes a mating region comprising a substantially outwardly concave configuration, wherein the mating region of the secondary surface perimeter and the work surface perimeter are substantially complementary.

9. The table apparatus of claim 8 further comprising:

an adjustment assembly coupling the support assembly to the surface assembly, the adjustment assembly comprising:

a first rotational coupling having a pair of spaced apart support axles, the first rotational coupling attached to the support assembly;

a second rotational coupling having a pair of spaced apart surface axles, the second rotational coupling attached to the surface assembly;

a pair of linkages of substantially the same length, each having a first end and a second end, the first end of each linkage coupled to one of the spaced apart support axles of the first rotational coupling, the second end of each linkage coupled to one of the spaced apart surface axles of the second rotational coupling, wherein when coupled, the linkages are substantially parallel to each other throughout rotation of the linkages relative to the support axles and surface axles between a first bottom position and a second top position, whereby movement between the first bottom position and the second top position maintains the at least one work surface of the surface assembly in a substantially constant planar orientation; and wherein the surface assembly comprises a table arm having a proximal end and a distal end, the work surface being mounted on the distal end, and the second rotational coupling located at the proximal end.

* * * * *